United States Patent [19]

Bintner

[11] 4,128,206

[45] Dec. 5, 1978

[54] LOW DRIFT FLAT SPRAY NOZZLE AND METHOD

[75] Inventor: Dennis W. Bintner, Des Moines, Iowa

[73] Assignee: Delavan Corporation, West Des Moines, Iowa

[21] Appl. No.: 801,836

[22] Filed: May 31, 1977

[51] Int. Cl.[2] ..... B05B 1/04

[52] U.S. Cl. ..... 239/11; 239/590; 239/599

[58] Field of Search ..... 239/432, 590, 590.3, 239/590.5, 599, 11, 472

[56] References Cited

U.S. PATENT DOCUMENTS

| | | | |
|---|---|---|---|
| 735,287 | 8/1903 | Neuendorff | 239/399 |
| 1,012,436 | 12/1911 | Ransome et al. | 239/432 X |
| 1,826,776 | 10/1931 | Gunther | 239/432 X |
| 2,046,592 | 7/1936 | Tracy | 239/402 |
| 2,386,918 | 10/1945 | Timpson | 239/590.3 X |
| 2,988,288 | 6/1961 | Nielsen | 239/590.5 X |
| 3,000,576 | 9/1961 | Levey et al. | 239/499 |
| 3,199,790 | 8/1965 | Giesemann | 239/432 X |
| 3,556,411 | 1/1971 | Nord et al. | 239/599 X |
| 3,604,509 | 9/1971 | Sachnik | 239/171 X |
| 3,693,886 | 9/1972 | Conrad | 239/432 |
| 3,701,482 | 10/1972 | Sachnik | 239/590.3 |
| 3,747,851 | 7/1973 | Conrad | 239/432 X |
| 3,784,111 | 1/1974 | Piggott | 239/432 X |
| 3,836,076 | 9/1974 | Conrad et al. | 239/432 X |
| 3,934,823 | 1/1976 | Reed | 239/472 |
| 3,948,444 | 4/1976 | Reed | 239/11 |

*Primary Examiner*—Johnny D. Cherry

*Attorney, Agent, or Firm*—Allegretti, Newitt, Witcoff & McAndrews

[57] ABSTRACT

A nozzle and method for generating a flat spray discharge having substantially large droplets of liquid therein, wherein the liquid is jetted from an orifice against an impingement partition plate to cause it to become extremely turbulent in a gas free turbulence chamber defined between the orifice and the partition plate. This substantially gas free, turbulent liquid is then flowed around the impingement partition plate to a second chamber and is discharged from an elliptical discharge orifice at the end of the second chamber to produce a flat spray discharge having substantially large droplets of liquid therein.

14 Claims, 4 Drawing Figures

LOW DRIFT FLAT SPRAY NOZZLE AND METHOD

BACKGROUND AND SUMMARY OF THE INVENTION

This invention relates to low drift spray nozzles and a method of spraying and, more particularly to spray nozzles and a method of spraying in which a flat spray is produced having large droplets of liquid therein.

The production of sprays having substantially large droplets and low drift characteristics has become increasingly important in recent years. By way of example, one application in which drift must be minimized is in the application of herbicides, pesticides and other farm chemicals. Indeed, Federal, as well as local agencies have frequently arbitrarily set limits on the amount of drift which is permissible in the application of certain chemicals and other materials.

Several approaches have been taken in the past in an attempt to minimize spray drift.

One such approach utilizes flooding or deflector type nozzles which are generally operated at very low pressures, frequently as low as 3 or 4 psig. These low pressures result in the generation of large droplets which reduce the possibility of drift hazards. However, the low pressures in such flooding or deflector type nozzles produce several important disadvantages, including difficulty in obtaining a good spray patternation and coverage uniformity. In addition, any variation in the supply pressure or pressure losses in the equipment itself inherent in the piping will cause a change of flow rate through the nozzles and adversely affect uniformity of coverage.

Another approach to reduce drift has been to foam the liquid being sprayed. U.S. patent to Sherman E. Conrad and Dennis W. Bintner, U.S. Pat. No. 3,836,076, discloses a nozzle useful in such foaming techniques. Such foaming techniques, likewise, suffer several disadvantages. One disadvantage is that a particular foam generating liquid must be utilized at the application site to produce the foamed discharge. Such liquid not only constitutes an added expense, but also necessitates the provision of extra equipment, such as extra tanks and metering equipment. In addition such foam generating nozzles and equipment are relatively bulky and require the introduction of air into the foam generating nozzle. Moreover, the nozzle shown in the last mentioned Letters Patent includes a plurality of small jetting nozzles which may be subject to plugging from contaminants.

In U.S. patent to Kenneth E. Reed, U.S. Pat. No. 3,934,823, a low drift spray nozzle and method are disclosed for producing a hollow conical spray cone composed primarily of large droplets of liquid to reduce drift. In that nozzle and method, a swirling motion is first imparted to the liquid and then this swirling liquid is passed through several orifices to form the swirling hollow conical discharge containing the large droplets of the liquid. The nozzle and method disclosed in the last mentioned patent ovecome many of the disadvantages inherent in the use of flooding or deflector type nozzles and the foam systems.

The present invention is an improvement over the nozzle and method disclosed in U.S. Pat. No. 3,934,823 in that the nozzle and method of the present invention are capable of producing a flat spray pattern having large droplets of liquid therein, rather than the large droplet, hollow conical pattern disclosed in the last mentioned patent. In the nozzle and method incorporating the principles of the present invention, liquid pressures greatly in excess of those employed with the prior flooding or deflector type nozzles may be utilized and yet the generation of large droplets which are not subject to drift is optimized. Accordingly, since the method and nozzles of the present invention are capable of operating under substantially higher line pressures, the adverse effect of changes in elevation, frictional losses and the like attending the use of the flooding or deflector type nozzles are minimized. The nozzles and method incorporating the principles of the present invention result in excellent patternation definition and uniform distribution of droplet sizes and droplet quality is not substantially altered by changes in size or capacity of the nozzles. The nozzles and method of the present invention also result in a large droplet, low drift spray without necessitating the addition of foaming agents, air or other gases to the spray and thereby avoid the disadvantages inherent in the use of such additional fluids. Finally, the nozzles and method incorporating the principles of the present invention are simple and compact in manufacture, construction and operation, and are not subject to plugging from contaminants.

In a principal aspect of the present invention, a nozzle for producing a flat spray discharge having substantially large droplets of liquid therein, includes a substantially gas free turbulence chamber, first orifice means for introducing a jet of liquid into the turbulence chamber, a second chamber, partition means between the turbulence chamber and the second chamber having a surface positioned in the path of the jet such that the jet of liquid impinges on the surface to cause turbulence in the turbulence chamber, passage means for conducting the turbulent liquid past the partition means from the turbulence chamber to the second chamber, and discharge orifice means at the end of the second chamber for discharging the turbulent liquid from the second chamber in the form of the flat spray pattern having large liquid droplets therein.

In another principal aspect of the present invention, a method of producing large droplets of liquid includes producing a jet of the liquid, directing the jet of liquid against an impingement surface to produce a substantially gas free zone of turbulence adjacent the upstream side of the impingement surface, flowing the turbulent liquid from the zone of turbulence past the impingement surface to a chamber, and discharging the turbulent liquid from the chamber through a discharge orifice.

These and other objects, features and advantages of the present invention will be more clearly understood through a consideration of the following detailed description.

BRIEF DESCRIPTION OF THE DRAWINGS

In the course of this description, reference will frequently be made to the attached drawing in which.

DESCRIPTION OF THE PREFERRED EMBODIMENTS

Figures 1, 2, 3, 4:
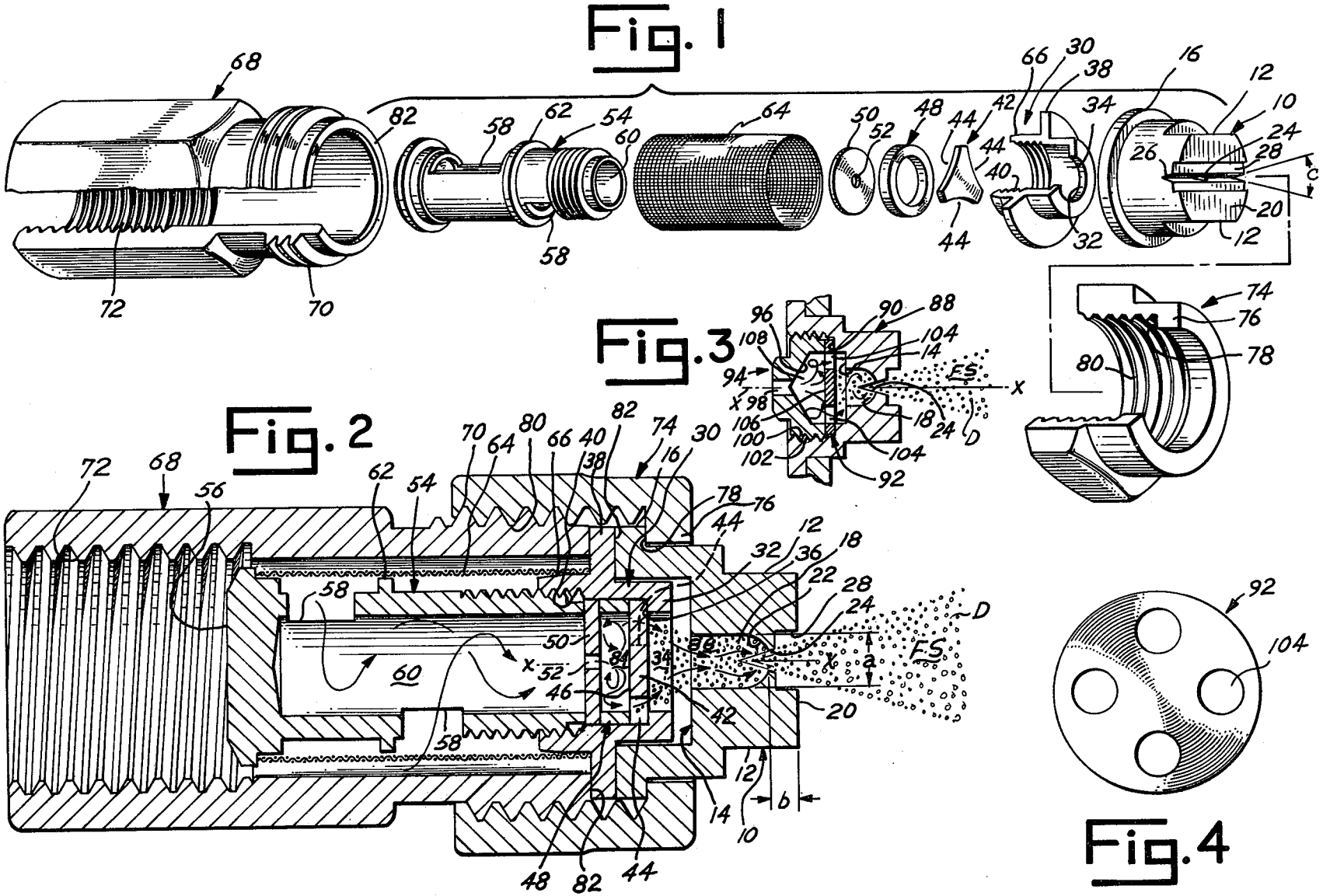
FIG. 1 is an exploded isometric view of a preferred embodiment of nozzle incorporating the principles of the present invention and which employs the method of the present invention.
FIG. 2 is a cross sectiona elevation view of the assembled nozzle shown in FIG. 1 and showing the liquid flow path of the liquid.
FIG. 3 is a cross sectional elevation view of another embodiment of nozzle incorporating the principles of the present invention, and which employs the method of the present invention.
FIG. 4 is an end elevation view of the impingement partition plate shown in FIG. 3.

Referring particularly to FIGS. 1 and 2, a preferred embodiment of nozzle is shown which is constructed in accordance with the principles of the present invention and which practices the method of the invention. The nozzle comprises a nozzle tip member 10 of a generally cylindrical shape which is flattened at its frontal end at 12 for reception of a tool. The nozzle tip 10 includes an enlarged cup-shaped portion 14, as shown in FIG. 2, and a circular flange 16 which extends beyond the perimeter of the cylindrical nozzle tip at its left end as viewed in FIGS. 1 and 2. A generally cylindrical advance passage 18 of diameter *a* is bored in the frontal end of the nozzle tip as viewed in FIG. 2 and terminates by a distance *b* short of the nozzle tip face 20 in a spheroidally shaped dome 22. A V-cut discharge orifice 24 is formed in the frontal end of the nozzle tip by cutting an angled slot 26, the walls of which diverge at an angle *c*, as shown in FIG. 2, at the base of a rectangular recession 28. Due to the intersection of the angled slot 26 with the spheroidally shaped dome 22, the discharge orifice 24 is generally elliptical in shape, as is common for a flat spray nozzle.

A retainer 30, also of generally cylindrical shape, is provided which has a diameter such as to fit within the cup-shaped portion 14 of the nozzle tip. The frontal end of the retainer includes an internally extending flange 32 having an enlarged opening 34 extending therethrough. The flange 32 forms a rearwardly facing shoulder 36 for retaining additional nozzle elements as will be described hereinafter. The retainer 30 also includes an exterior flange 38 extending from its exterior wall at a location intermediate the cylindrical body of the retainer. The flange 38 has a maximum diamerter substantially equal to the maximum diameter of flange 16, such that the two flanges butt together when the retainer 30 is inserted into the nozzle tip 10 as shown in FIG. 2. The left interior portion of the retainer preferably extends beyond flange 38 and is threaded at 40 to receive a comparably threaded member for retaining the several elements which are to be positioned in the retainer.

An impingement partition plate 42, having a maximum diameter substantially equal to the internal diameter of the retainer 30, is positioned in the retainer against shoulder 36. The impingement partition plate 42 comprises a plate or disc in which a plurality of reversely arcuate cutouts 44 are present so as to define fluid flow passages through the plate and the rear center of the plate defines a solid impingement surface 46 as shown in FIG. 2.

A circular spacer ring 48, also having a diameter substantially equal to the interior diameter of the retainer, is next positioned in the retainer 30 against the impingement partition plate 42.

An orifice metering disc 50 is positioned in the interior of retainer 30. The metering disc 50, likewise, has a diameter substantially equal to the diameter of the impingement plate 42 and spacer ring 44 and has an orifice 52 extending centrally and axially through the disc 50.

In assembling the nozzle, the impingement plate 42 is first positioned in the cavity of the retainer 30 until it abuts the shoulder 36 of flange 32. In this position, the reversely arcuate cutouts 44 of plate 42 open between the left and right hand sides of the plate to define fluid flow passages past the impingement partition plate 42 and flange 32 of the retainer 30. Next, the spacer ring 48 is positioned in the cavity of the retainer 30 against the plate 42, and then the orifice metering disc 50 is positioned in the cavity against the ring 48.

All of these elements are held in place by threading a suitable retaining element into abutment against the orifice metering disc into the cavity of the retainer member. Such retaining element may comprise, for example, the end of a strainer body 54 as shown in FIGS. 1 and 2. Strainer body 54 comprises an elongate tubular member closed at its upstream end by a cap 56. Cutouts 58 in the strainer body define fluid flow passages from the filtrate side of the strainer to the interior flow passage 60 of the strainer body. In addition, one or more flanged strainer supports 62 may be spaced along the exterior of the strainer body to support cylindrical mesh strainer 64 as shown in FIG. 2.

Mesh strainer 64, preferably of metal mesh, surrounds the strainer body 54 and, preferably, fits over the exterior end 66 of the retainer 30 as shown in FIG. 2. Thus, assembly of the strainer as shown in FIG. 2 acts to retain the several elements, i.e. impingement partition plate 42, spacer ring 48 and orifice metering disc 50 in the cavity of the retainer 30.

A nozzle body 68 is provided which is exteriorly threaded at 70 at its right end as viewed in FIGS. 1 and 2, and is interiorly threaded at 72 for coupling to a suitable liquid conduit (not shown). A cap member 74, having an internal flange 76 which defines a rearward facing shoulder 78, and having an internally threaded passage 80 is provided to complete the assembly of the nozzle.

In assembling the nozzle, the nozzle tip 10 is first inserted into the cap 74 until its flange 16 abuts the internal shoulder 78 of flange 76 of the cap 74 and its frontal face 20 extends out of the cap. Next, the assembled retainer 30, impingement partition plate 42, spacer ring 48, orifice metering disc 50 and strainer body 54 with the mesh strainer 64 on it, are inserted into the cupped-shaped portion 14 of the nozzle tip 10 as shown in FIG. 2. When inserted, the threads on the strainer body 54 are threaded into threads 40 and flanges 16 and 38 abut each other such that the flanges 32 of the retainer 30 are spaced somewhat from the end of the cup shaped partition 14 of the nozzle tip 10 to allow for flow from cutouts 44 to passage 18. Lastly, the nozzle body 68 is threaded, by threads 70 and 80, into the cap until the forward end 82 of the nozzle body abuts the rear side of flange 38 of the retainer 30 to hold all of the elements in place. Thus, in the final assembly the discharge orifice 24, passage 18, the center of the impingement partition plate 42 and orifice 52 are all substantially aligned along a central axis *x*, and the cutouts 44 in plate 42 are spaced from axis *x*.

Referring to FIG. 2, it will be seen that the assembly actually defines two chambers. A first chamber 84 is a turbulence chamber which is define by the rear face of impingement partition plate 42, spacer ring 48, and the frontal face of orifice metering disc 50. The second chamber 86, is defined by the elongate cylindrical spheroidal ended passage 18 in the nozzle tip.

In operation, liquid flows through the threaded portion 72 of the nozzle body 68 around the outside of strainer 64, through the strainer 64 and cutouts 58 into passage 60 in the strainer body 54 to fill that passage. This liquid is then jetted through orifice 52 in orifice metering disc 50 to form a jet of liquid which impinges the rear center surface of impingement partition plate 42. Such impingement creates extreme turbulence in turbulence chamber 84 as shown by the arrows in that chamber in FIG. 2.

This extremely turbulent and substantially gas free liquid then flows away from axis *x* and past the impingement partition plate 42 to the second chamber 86 by way of the arcuate cutouts 44 in plate 42 which are spaced from axis *x*. The liquid, which is still extremely turbulent, then departs from the second chamber by way of the elliptical discharge orifice 24 to form a flat fan-shaped spray FS having primarily extremely large droplets D in the spray.

It has been found that the jetting of the jet of liquid through orifice 52 against the rear side of impingement partition plate 42 to induce substantial turbulence in chamber 84 results in the production of the large droplet spray contemplated by the present invention. Without such turbulent liquid, a fine mist flat spray would otherwise be produced as in conventional flat spray nozzles.

By way of example the median droplet diameters and percentages of volume under 100 microns of the spray discharge of two nozzles constructed in accordance with the invention (hereinafter denoted Nozzle Nos. 2 and 4) are compared with the same parameters in a conventional flat spray nozzle of substantially identical construction to Nozzle No. 2, except that the impingement partition plate 42, orifice metering plate 50 and turbulence chamber 84 were absent in the conventional nozzle. All three nozzles were operated at a pressure drop of 40 psig. Nozzle No. 2 and the conventional nozzle had flow rates of approximately 0.20 gpm, and Nozzle No. 4 had a flow rate twice as large, i.e. approximately 0.40 gpm. A comparison of the nozzle tip dimensions and orifice metering disc 50 size of Nozzle Nos. 2 and 4 were as follows, referring to FIGS. 1 and 2:

| | Tip Dimensions | | | | |
|---|---|---|---|---|---|
| Nozzle | Approach Passage dia., in. a | Depth, in. b | Cutter Angle, c | Diameter of Circle Equiv. to Elliptical Discharge Orifice, in | Metering Disc Orifice dia., in. |
| No. 2 | 0.082 | 0.025 | 30° | 0.0544 | 0.041 |
| No. 4 | 0.130 | 0.025 | 35° | 0.0752 | 0.062 |

The spray quality (using water) of the conventional flat spray nozzle compared to Nozzle Nos. 2 and 4 which incorporated the principles of the invention and practiced the method of the invention are as follows:

| Nozzle | Volume Median Droplet Diameter, microns | Volume of Liquid under 100 microns, % |
|---|---|---|
| Conventional | 193.5 | 11.0 |
| No. 2 | 522 | 1.3 |
| No. 4 | 530 | 2.0 |

It is clearly seen from the above table that both Nozzle Nos. 2 and 4 constructed and operated in accordance with the principles of the present invention produced a high median droplet diameter in excess of 500 microns and a low volume of droplets under 100 microns in diameter, i.e. 2% or less. On the contrary, the conventional flat spray nozzle without the impingement partition plate 42, orifice metering disc 50 or turbulence chamber 84, produced a flat spray of extremely fine mist having low median droplet diameter and a high percentage of droplets under 100 microns.

It will also be seen that even though the capacity of Nozzle No. 4 was double that of Nozzle No. 2, little if any effect on the droplet quality is observed. It is believed that the large droplet contemplated by the present invention can readily be obtained over a wide range of nozzle capacities, e.g. 0.06 gpm to 0.8 gpm.

In addition, several tests were conducted with Nozzle Nos. 2 and 4 in which the pressure drops across the nozzles were widely varied between 10 psi and 60 psi. Accordingly, the flow rates in Nozzle Nos. 2 and 4 widely varied with these varying pressures. In the case of Nozzle No. 2, at 10 pounds psi, the flow rate was approximately 0.10 gpm, and at 60 pounds was 0.26 gpm. In Nozzle No. 4, the flow rate at 10 psi was approximately 0.21 gpm and at 60 psi was 0.49 gpm. Even with these wide variations in pressure across the nozzle, it was found that droplet quality did not substantially deteriorate. The principal effect of the pressure changes wasto vary the spray angle. It was noted that the classic pressure-flow square root relationship applied over the range of these pressure changes.

It is believed that the excellent uniform performance of the nozzle and method of the present invention over wide ranges of pressure and flow rates is due to the fact that the principal portion of the pressure drop across the nozzle occurs across orifice 52. Thus, only minor pressure drop is experienced in the turbulent liquid as it is discharged from the discharge orifice 24. This is contrary to the operation of the conventional flat spray nozzle in which substantially all of the pressure drop occurs across the final discharge orifice.

Patternation tests widely used by the industry in the evaluation of flat sprays were conducted with the Nozzle Nos. 2 and 4 at 40 psi. These tests demonstrated that the patternation of the large droplet flat spray produced by Nozzle Nos. 2 and 4 was excellent and exhibited little if any tailing at the edges of the spray. From these patternation tests, it is clear that the use of the nozzle and method of the present invention in a tandem spray rig in which the nozzles are spaced along a manifold such that the spray pattern from one nozzle overlaps the pattern of the next nozzle is desirable and will result in a uniform application of the liquid. Moreover, such patternation tests indicate that the nozzle and method of the present invention may be desirable in a wide range of uses in addition to agricultural application of chemicals, such as airless paint spraying.

Referring now to FIGS. 3 and 4, a second preferred embodiment of flat spray nozzle constructed in accordance with the principles of the invention and employing the method of the invention is disclosed. The embodiment shown in FIGS. 3 and 4 is slightly different than the embodiment shown in FIGS. 1 and 2 in that the construction of the impingement partition plate, retainer member and turbulence chamber have been modified somewhat and the entire construction has been simplified.

The nozzle tip 88 of this embodiment is substantially identical to nozzle tip 10 as shown in FIG. 2, except that an additional shoulder 90 has been provided in spaced relation to the approach passage 18. The purpose of shoulder 90 is to receive directly and position the impingement partition plate 92 and to space that plate from the face of cup shaped portion 14.

The construction of the orifice metering disc 94 has also been changed somewhat over the disc 50 shown in FIGS. 1 and 2. In FIG. 3, the orifice metering disc comprises a cup shaped member defining a cup shaped portion 96 on the downstream side of the metering orifice 98. The exterior of the orifice metering disc is threaded at 100 so that it may be threaded into complementary threads 102 in the nozzle tip.

The impingement partition plate 92 is also somewhat different in configuration in that instead of the reversely arcuate cutouts 44 shown in FIG. 1, a plurality of apertures 104 are radially spaced about the outer perimeter of the disc 92, thereby to define an impingement surface 106 in the center of the upstream side of the disc.

The remaining parts of the nozzle embodiment shown in FIGS. 3 and 4 have been omitted. It will be understood, however, that the nozzle construction shown in FIG. 3 will otherwise be identical to the nozzle shown in FIGS. 1 and 2 and will include the nozzle body 68 and cap 74, and may also include a strainer assembly similar to the assembly shown in FIGS. 1 and 2. When assembled, the discharge orifice 24, passage 18, plate 92 and its impingement surface 106, turbulence chamber 108 and orifice 98 are all substantially coincident with axis $x$ and the apertures 104 are radially spaced from axis $x$.

In operation of the embodiment shown in FIGS. 3 and 4, liquid is introduced through orifice 98 and jetted against the impingement surface 106 of impingement partition plate 92. The jetting of this liquid will set up an extreme turbulence in the liquid in the substantially gas free turbulence chamber 108, the latter of which is generally defined by the cup shaped portion 96 and the impingement partition disc 92. This substantially gas free turbulent liquid will then flow away from axis $x$ and through the passages formed by apertures 104 into a second chamber defined by the advance passage 18 and the space between the beginning of the advance passage and the right side of the impingement partition plate as viewed in FIG. 3. Finally, the turbulent liquid in advance passage 18 will be discharged through the discharge orifice 24 to form a flat spray discharge FS having large droplets of liquid D entrained therein.

It should be appreciated that the fluid which is impinged against impingement plates 42 and 92 is jetted against the plates by a substantially axially positioned orifice 52 or 98, respectively. Thus, a multiplicity of small orifices is eliminated and the possibility of clogging from contaminants is substantially reduced.

It will be understood that although the apertured impingement partition plate 92 is shown in FIG. 3, that an impingement plate such as plate 42 shown in FIG. 1 may be readily substituted for the apertured plate and vice versa. It will also be understood that the embodiments of the present invention which have been described are merely illustrative of a few of the applications of the principles of the invention. Numerous modifcations may be made by those skilled in the art without departing from the true spirit and scope of the invention.

What is claimed is:

1. A nozzle for producing a flat spray discharge having substantially large droplets of liquid therein, said nozzle comprising a substantially gas free turbulence chamber, first orifice means for introducing a jet of liquid into said turbulence chamber, a second chamber, partition means between said turbulence chamber and said second chamber, said partition means having a surface positioned in the path of said jet upon which said jet of liquid impinges to cause substantial turbulence in the liquid in the turbulence chamber, passage means for conducting the turbulent liquid past said partition means from said turbulence chamber to said second chamber, and discharge orifice means at the end of said second chamber opposite said partition means, said discharge orifice means discharging said turbulent liquid from said second chamber in the form of a flat spray pattern having large droplets of liquid therein.

2. The nozzle of claim 1 wherein said first orifice means is located substantially axially of said turbulence chamber and said passage means are displaced from said axis such that said turbulent liquid in said turbulence chamber flows away from said axis as it moves from said turbulence chamber toward said second chamber.

3. The nozzle of claim 2 wherein said second chamber and discharge orifice means are also substantially coincident with said axis.

4. The nozzle of claim 1 wherein said partition means comprises a plate having edges arranged to permit the flow of the turbulent liquid past said edges from said turbulence chamber to said second chamber, said edges defining said passage means.

5. The nozzle of claim 4 wherein at least a portion of said edges of said plate are removed to define said passage means.

6. The nozzle of claim 1 wherein said partition means comprises a plate having a plurality of apertures extending therethrough between said turbulence chamber and said second chamber, said apertures defining said passage means.

7. The nozzle of claim 1 wherein said second chamber is elongate and is spheroidally shaped adjacent said discharge orifice.

8. The nozzle of claim 1 wherein said first orifice means comprises disc means having an orifice therein for forming said jet of liquid.

9. The nozzle of claim 1 including retaining means removable from said nozzle for positioning said partition means in said nozzle relative to said first orifice means, said retaining means also defining said turbulence chamber.

10. The nozzle of claim 9 wherein said first orifice means is formed integrally with said retaining means.

11. The nozzle of claim 9 including nozzle tip means which defines said second chamber and said discharge orifice means, and said retaining means positions said partition means in said nozzle tip means.

12. A method of producing large droplets of liquid comprising producing a jet of liquid, directing said jet of liquid against an impingement surface to produce a substantially gas free zone of substanial turbulence adjacent the upstream side of said impingement surface, flowing the gas free turbulent liquid from said zone of turbulence past said impingement surface to a chamber, and discharging said turbulent liquid from said chamber through a discharge orifice to form a flat spray having said large droplets of liquid therein.

13. The method of claim 12 wherein said jet of liquid, said chamber and said discharge orifice are substantially coaxial.

14. The method of claim 12 wherein the said turbulent fluid flows from said zone of turbulence to said chamber at an angle to said jet of liquid.

* * * * *